US005366017A

United States Patent [19]

Voss, Jr.

[11] Patent Number: 5,366,017

[45] Date of Patent: Nov. 22, 1994

[54] INTERMEDIATE CASING ANNULUS MONITOR

[75] Inventor: Robert K. Voss, Jr., Houston, Tex.

[73] Assignee: ABB Vetco Gray Inc., Houston, Tex.

[21] Appl. No.: 122,994

[22] Filed: Sep. 17, 1993

[51] Int. Cl.[5] ..... E21B 43/00

[52] U.S. Cl. ..... 166/368; 166/88

[58] Field of Search ..... 166/338-345, 166/350, 366, 368, 88

[56] References Cited

U.S. PATENT DOCUMENTS 3,971,576 7/1976 Herd et al. ..... 166/368
4,553,589 11/1985 Jennings et al. ..... 166/53
4,623,020 11/1986 Nichols ..... 166/88
5,143,158 9/1992 Watkins et al. ..... 166/368 X

*Primary Examiner*—Michael Powell Buiz
*Attorney, Agent, or Firm*—James E. Bradley

[57] ABSTRACT

A subsea well has communication passages to enable annulus pressure between the inner and intermediate strings of casing to be monitored at the surface. The communication passages include a passage through the upper casing hanger. This passage registers with a passage through the tubing hanger assembly. The passage in the tubing hanger assembly registers with a passage in the tree assembly. The passage in the tree assembly has an outlet at the exterior of the tree assembly, where it connects to a communication line that extends to production equipment at the surface.

14 Claims, 3 Drawing Sheets

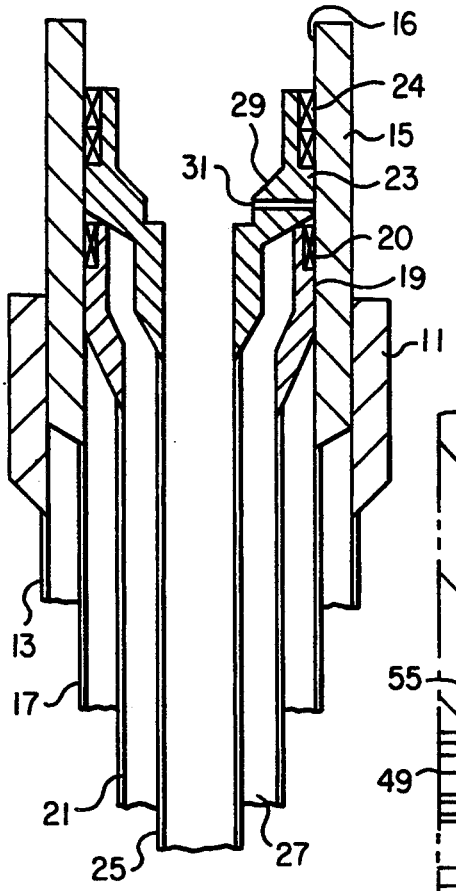
FIG. 1
FIG. 2A
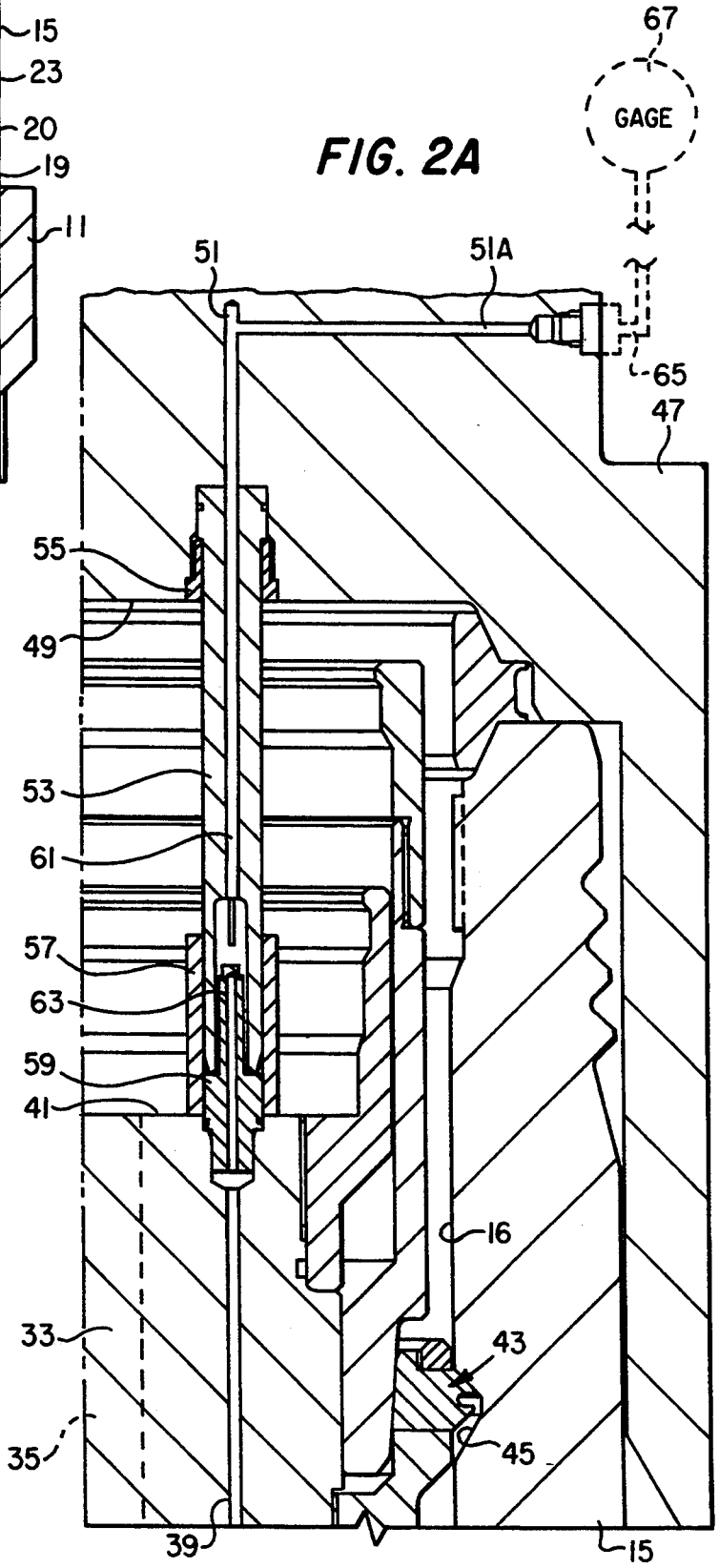

INTERMEDIATE CASING ANNULUS MONITOR

BACKGROUND OF THE INVENTION

1. Field of the Invention

This invention relates in general to subsea wells, and in particular to a means for monitoring the annulus pressure between a production casing string and an intermediate casing string.

2. Description of the Prior Art

Subsea wells of the type concerned herein will have an outer wellhead housing secured to a string of conductor pipe which extends to a first depth. A high pressure, or inner wellhead housing lands in the outer wellhead housing. The high pressure housing is secured to an outer string of casing, which extends through the conductor. An intermediate string of casing extends through the outer casing. The intermediate string of casing is supported at the upper end by a lower casing hangar which lands in the inner wellhead housing. A production or inner string of casing extends through the intermediate string of casing to the final depth. The inner string of casing is supported by an upper casing hanger which lands in the wellhead housing above the lower casing hanger. Both of the lower and upper casing hangers are sealed separately by casing hanger seals to the wellhead housing.

A tubing hanger assembly lands in the upper casing hanger. The tubing hanger assembly secures to a string of tubing that extends through the inner casing for producing well fluids. A tree assembly lands on the inner wellhead housing. The tree has valves and various controls for controlling the well production. The tubing hanger has a production flow passage through it for the production fluids and normally another passage for communication with the annulus surrounding the tubing.

A sealed annulus locates between the inner string of casing and the intermediate string of casing. Normally there will be no pressure in the annulus between the inner and intermediate strings of casing because production will be through perforations in the inner string of casing, and pressure in the in the lower portion of the inner string of casing is normally sealed by a packer. If pressure increased within this annulus, it would indicate that a leak exists in one of the strings of casing. The leak could be from several places. Possibly, during testing, the upper casing hanger seal leaked when pressure was applied to the wellhead housing. Possibly the packer or inner string of casing above the packer developed a leak. Possibly, the cement around the inner string of casing leaked. Regardless of the location, this leak could result in high pressure buildup in the annulus surrounding the inner string, which is not wanted. If high pressure resulted from a wellhead test, the high pressure could collapse a portion of the inner string. Currently, there are no techniques used to monitor the annulus pressure surrounding the inner string of casing.

SUMMARY OF THE INVENTION

The annulus pressure surrounding the string of inner casing is monitored by using internal communication passages. A communication passage extends through the upper casing hanger from the exterior of the upper casing hanger below the casing hanger seal to an outlet in the bore of the upper casing hanger. A lower end of the tubing hanger assembly lands in the bore of the upper casing hanger. A tubing hanger communication passage extends through this portion of the tubing hanger assembly. The tree assembly, which lands on the inner wellhead housing, has a tree communication passage that registers with the tubing hanger communication passage.

The communication passages communicate pressure in the annulus to the exterior of the tree. A communication line extends to monitoring equipment at the surface for monitoring the pressure.

In one embodiment, the tubing hanger assembly comprises a tubing hanger that locates in the bore of the upper casing hanger and locks to the inner wellhead housing. The tree has a lower portion that locates above the upper end of the tubing hanger. An extension member extends between the lower portion of the tree and the upper end of the tubing hanger to link the tubing hanger communication passage with the tree communication passage.

In another embodiment, the tree includes as part of its assembly a tubing hanger spool. The tubing hanger spool lands on the wellhead housing, with the tree mounted to the upper end of the tubing hanger spool. An extension sub extends from the bore of the upper casing hanger upward to the tubing hanger spool. The tubing hanger communication passage extends through the extension sub. The tree communication passage extends through the tubing hanger spool.

BRIEF DESCRIPTION OF THE DRAWING

FIG. 1 is a schematic sectional view illustrating portions of a subsea well assembly constructed in accordance with this invention.

FIGS. 2A and 2B are a sectional view of a first embodiment of a subsea well assembly constructed in accordance with this invention.

DETAILED DESCRIPTION OF THE INVENTION

Figure 2B:
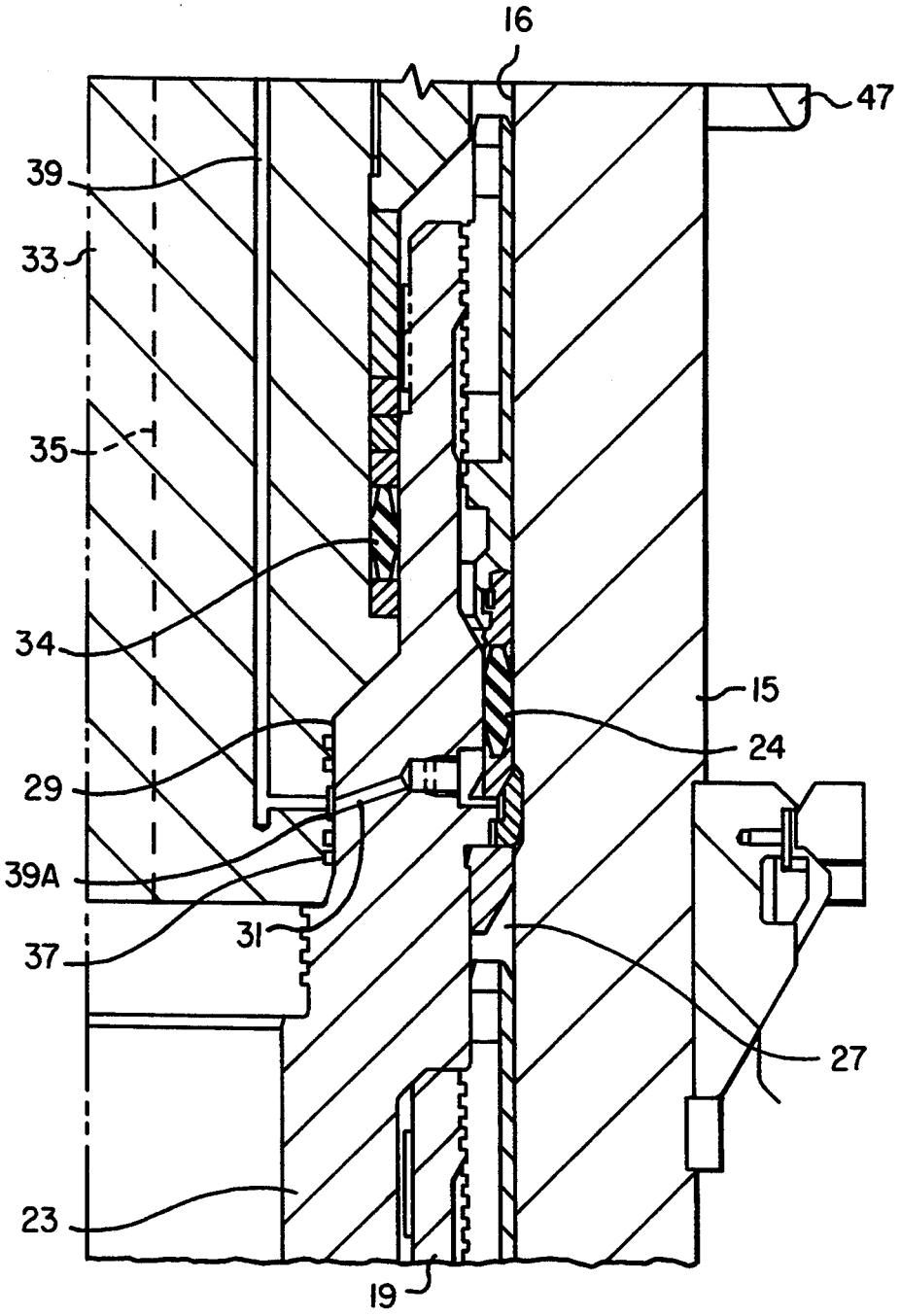

Referring to FIG. 1, the subsea well assembly includes an outer wellhead housing 11, which will locate on the floor of the sea. Outer wellhead housing 11 is a large tubular member that is secured to a string of conductor pipe 13. Conductor pipe 13 extends to a first depth in the well and is typically 30 inches in diameter.

An inner wellhead housing 15 lands in outer wellhead housing 11. Inner wellhead housing 15 is a high pressure tubular member having a bore 16. Inner wellhead housing 15 secures to a string of outer casing 17, normally 20 inches in diameter, which extends through conductor pipe 13 to a greater depth in the well.

A lower casing hanger 19 lands on a shoulder (not shown) in bore 16 of inner wellhead housing 15. Lower casing hanger 19 is sealed by casing hanger seal 20 to bore 16. Lower casing hanger 19 secures to a string of intermediate casing 21, typically 13 ⅜ inches in diameter. Intermediate casing 21 extends through outer casing 17 to a greater depth in the well.

An upper casing hanger 23 lands on lower casing hanger 19 and is sealed to bore 16 by a casing hanger seal 24. Upper casing hanger 23 secures to a string of inner or production casing 25. Inner casing 25, normally 9 ⅝ inches in diameter, extends through intermediate casing 21 to the total depth of the well.

An annulus 27 exists between intermediate casing 21 and inner casing 25. Annulus 27 also surrounds upper casing hanger 23 up to upper casing hanger seal 24. Annulus 27 is also located in the bore of lower casing hanger 19. Normally, there would be no pressure in annulus 27, other than atmospheric. Each of the strings of casing 17, 21 and 25 is cemented in the wellbore. Only a lower portion of inner casing 25 is exposed to the pressure in the earth formations, and this exposure is through perforations (not shown). A packer (not shown) will locate in inner casing 25 above these perforations to seal the pressure from the earth formation to a lower portion of the inner casing 25. Pressure other than atmospheric exists in annulus 27 only when a leak occurs.

Upper casing hanger 23 has a bore 29. A communication passage 31 extends laterally through upper casing hanger 23 from annulus 27 to bore 29. In the embodiment of FIGS. 2A and 2B, a tubing hanger 33 lands in bore 29. Tubing hanger 33 supports a string of tubing (not shown) which extends through inner casing 25. The packer (not shown) will seal the lower end of tubing in inner casing 25 by isolating the zone of interest. Oil or gas will be produced through the string of tubing.

Pressure in annulus 27 is monitored by providing a communication path from annulus 27 to the exterior of inner wellhead housing 15. The communication path includes the casing hanger communication passage 31, shown in more detail in FIG. 2B. Casing hanger communication passage 31 extends from the exterior of upper casing hanger 23 below seal 24 to bore 29. Any pressure in annulus 27 will be communicated to bore 29.

In the embodiment of FIGS. 2A and 2B, the tubing hanger 33 lands in bore 29. A seal 34 seals the tubing hanger 33 to bore 29. Tubing hanger 33 has two flow passages 35 (only one schematically shown) which extend parallel to the axis, one for the passage of production fluids through string of tubing (not shown), and the other for communication with the annulus surrounding the tubing. Seals 37 seal the lower end of tubing hanger 33 in bore 29 above and below casing hanger communication passage 31.

A tubing hanger communication passage 39 registers with casing hanger communication passage 31. An inlet portion 39A includes an annular groove and a lateral portion so that passages 39 and 31 will register without having to rotationally orient the tubing hanger 33. Seals 37 prevent leakage at the junction between the passages 31, 39. Tubing hanger communication passage 39 has an axial portion that is parallel to and isolated from flow passages 35. The axial portion of passage 39 extends to an upper end 41 of tubing hanger 33, shown in FIG. 2A. A conventional tubing hanger locking assembly 43 will lock tubing hanger 39 in place. The locking assembly 43 is not described in detail as it does not deal with this invention. A locking element of locking assembly 43 locks into a groove 45 provided in bore 16 of inner wellhead housing 15.

A tree assembly, including tree 47, lands on inner wellhead housing 15 in the embodiment FIGS. 2A and 2B. Tree 47 has a lower interior portion 49 that locates above inner wellhead housing 15, above tubing hanger upper end 41, and faces downward. This results in a space between lower interior portion 49 and tubing hanger upper end 41. A tree communication passage 51 extends upward from lower interior portion 49. Tree communication passage 51 has a lateral portion 51A that leads to an outlet on the exterior of tree 47.

An extension member 53 links the outlet of tubing hanger communication passage 39 at the tubing upper end 41 to the inlet of tree communication passage 51 at tree lower interior portion 49. Extension member 53 is a tubular member. The upper end extends into a counterbore of tree communication passage 51 and is secured by a retainer ring 55. The lower end of extension member 53 inserts slidingly into a sleeve 57. Sleeve 57 is secured to the upper end 41 of tubing hanger 33. A mandrel 59 locates within sleeve 57. Mandrel 59 has a lower portion secured by threads in a counterbore of tubing hanger communication passage 39. An upper portion of mandrel 59 extends upward in sleeve 57. Extension member 53 has a tubular receptacle that slides over the upper portion of mandrel 59. Extension member 53 has an axial passage 61 which registers with an axial passage 63 in mandrel 59. Passages 61, 63 provide a communication path for tubing hanger communication passage 39 with tree communication passage 51. A communication line 65 secures to the outlet of tree communication passage 51. Communication line 65 is preferably a hollow tube that extends to a gage or monitoring equipment 67 located at a production platform at the surface.

In the operation of the embodiment of FIGS. 2A and 2B, any pressure in annulus 27 (FIG. 2B) communicates through casing hanger communication passage 31, tubing hanger communication passage 39, mandrel passage 63, extension member passage 61, tree communication passage 51 and communication line 65 to the gage 67. This pressure reading provides information to personnel at the production platform.

Figure 3:
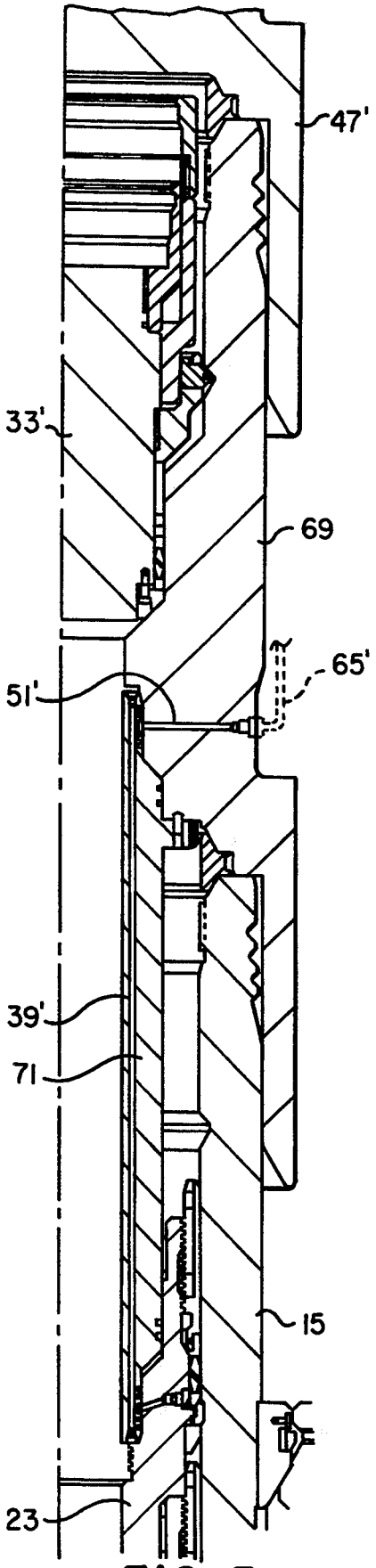
FIG. 3 is a sectional view of a second embodiment of a subsea well assembly constructed in accordance with this invention.
Figure 4:
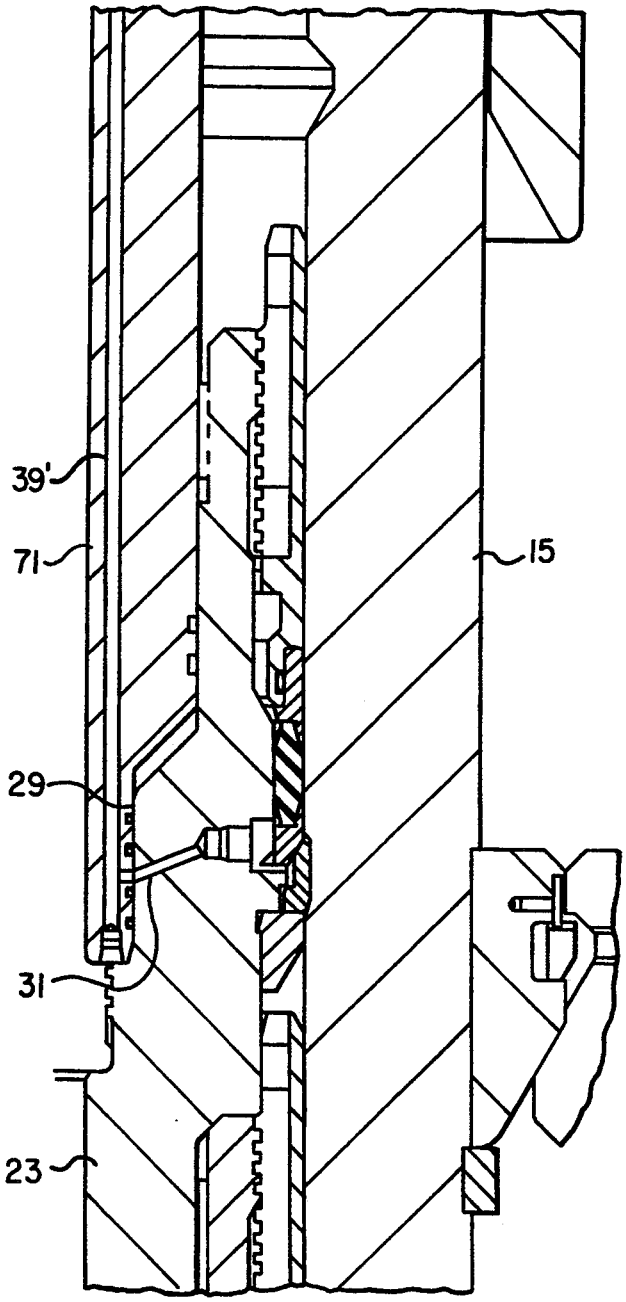
FIG. 4 is an enlarged sectional view of a portion of the subsea well assembly of FIG. 3.

FIGS. 3 and 4 illustrate an alternate embodiment. The components with the same numerals in FIGS. 3 and 4 as in FIGS. 2A, 2B are substantially identical. The components with the prime symbols are modified slightly from those shown in FIGS. 2A and 2B. Tree 47' includes as part of its assembly a tubing hanger spool 69. Tubing hanger spool 69 lands on inner wellhead housing 15. Tree 47' lands on spool 69. Tubing hanger 33' lands in tubing hanger spool 69, rather than in upper casing hanger 23. The tubing hanger assembly includes an extension sub 71 which connects the bore 29 (FIG. 4) of casing hanger 23 to tubing hanger spool 69. Extension sub 71 is a tubular member, the lower end of which sealingly engages bore 29 of casing hanger 23. The upper end sealingly engages a portion of tubing hanger spool 69.

Tubing hanger communication passage 39' extends axially through extension sub 71. The lower end of tubing hanger communication passage 39' registers with casing hanger communication passage 31. As shown in FIG. 3, tree communication passage 51' extends through tubing hanger spool 69. Communication line 65' connects to the outlet of tree communication passage 51'.

The operation of the embodiment of FIGS. 3 and 4 is the same as the first embodiment. Any pressure in the annulus surrounding casing hanger 23 communicates through casing hanger passage 31, tubing hanger communication passage 39', tree communication passage 51', and communication line 65' to monitoring equipment at the surface platform.

The invention has significant advantages. The communication passages enable pressure from the annulus between the inner and intermediate strings of casing to be communicated to the exterior of the inner wellhead housing. This enables the pressure to be readily monitored. No holes are required to be drilled through the inner wellhead housing. There is no requirement for pressure sensors to be positioned in difficult to reach areas, such as below the upper casing hanger.

While the invention has been shown in only two of its forms, it should be apparent to those skilled in the art that it is not so limited but is susceptible to various changes without departing from the scope of the invention.

I claim:

1. In a subsea well having a wellhead housing secured to a string of outer casing, a lower casing hanger landed in the wellhead housing and secured to a string of intermediate casing extending through and below the outer casing, an upper casing hanger sealed by a casing hanger seal in the wellhead housing above the lower casing hanger and secured to a string of inner casing extending through and below the intermediate casing, the upper casing hanger having a bore which sealingly receives a lower end of a tubing hanger assembly, and a subsea tree assembly which mounts on the wellhead housing, the improvement comprising:

casing hanger communication passage means extending through the upper casing hanger from the exterior of the upper casing hanger below the casing hanger seal to an outlet in the bore of the upper casing hanger for communicating annulus pressure between the inner casing and intermediate casing to the bore of the upper casing hanger; and tubing hanger and tree assembly communication passage means in communication with the outlet of the casing hanger communication passage means, extending through at least a portion of the tubing hanger assembly and tree assembly to the exterior of the tree assembly, for communicating the annulus pressure to a production monitoring equipment.

2. The subsea well according to claim 1, wherein the tubing hanger assembly has a tubing hanger flow passage that extends parallel to an axis of the wellhead housing, and wherein the tubing hanger and tree assembly communication passage means is isolated from the flow passage.

3. In a subsea well having a wellhead housing secured to a string of outer casing, a lower casing hanger landed in the wellhead housing and secured to a string of intermediate casing extending through and below the outer casing, an upper casing hanger sealed by a casing hanger seal in the wellhead housing above the lower casing hanger and secured to a string of inner casing extending through and below the intermediate casing, the upper casing hanger having a bore which sealingly receives a lower end of a tubing hanger assembly connected to a string of tubing, and a subsea tree assembly which mounts on the wellhead housing, the improvement comprising:

a casing hanger communication passage extending through the upper casing hanger from the exterior of the upper casing hanger below the casing hanger seal to the bore of the upper casing hanger;

a tubing hanger communication passage extending through at least a portion of the tubing hanger assembly, having an inlet on the exterior of the lower end of the tubing hanger assembly which is in communication with the casing hanger communication passage and an outlet above the casing hanger seal; and a tree communication passage having an inlet which communicates with the outlet of the tubing hanger communication passage and an outlet on an exterior portion of the tree assembly, for communicating annulus pressure between the inner casing and intermediate casing to the exterior of the tree assembly.

4. The subsea well according to claim 3, further comprising:

a communication line extending from the outlet of the tree communication passage to production equipment at a production platform for communicating the annulus pressure at the exterior of the tree assembly to a pressure monitor at the production platform.

5. The subsea well according to claim 3, wherein the lower end of the tubing hanger assembly has a tubing hanger flow passage that extends parallel to an axis of the wellhead housing for the passage of well fluids flowing through the tubing, and wherein the tubing hanger communication passage is isolated from the tubing hanger flow passage.

6. The subsea well according to claim 3, further comprising:

a communication tube extending from the outlet of the tree communication passage to a production platform for communicating the annulus pressure at the exterior of the tree assembly to a pressure monitor which measures the annulus pressure.

7. The subsea well according to claim 3, wherein:

the casing hanger communication passage extends laterally through the upper casing hanger;

the tubing hanger communication passage has a portion which extends axially through at least a portion of the tubing hanger assembly; and the tree communication passage has a portion which extends laterally through a portion of the tree assembly.

8. The subsea well according to claim 3, wherein:

the tubing hanger assembly comprises a tubing hanger having an upper end;

the outlet of the tubing hanger communication passage is on an upper end of the tubing hanger;

the tree assembly includes a tree which lands on the wellhead housing and has an interior lower portion spaced above the upper end of the tubing hanger; and the tree communication passage includes a tubular extension member extending from the outlet of the tubing hanger communication passage to the interior lower portion of the tree.

9. The subsea well according to claim 3, wherein:

the tree assembly comprises a tubing hanger spool which lands on the wellhead housing and a tree which lands on the tubing hanger spool;

the tubing hanger assembly comprises a tubing hanger which lands in the tubing hanger spool and an extension sub which lands in the upper casing hanger and connects to the tubing hanger spool;

the tubing hanger communication passage extends through the extension sub; and the tree communication passage extends through the tubing hanger spool.

10. In a subsea well having a wellhead housing having an axial bore and secured to a string of outer casing, a lower casing hanger landed in the bore of the wellhead housing and secured to a string of intermediate casing extending through and below the outer casing, an upper casing hanger sealed by a casing hanger seal in the bore of the wellhead housing above the lower casing hanger and secured to a string of inner casing extending through and below the intermediate casing, the upper casing hanger having a bore which sealingly receives a lower end of a tubing hanger, which is secured to a string of tubing and has a flow passage for the passage of well fluids flowing through the tubing, and a subsea tree which mounts on the wellhead housing and has a lower interior portion spaced above an upper end of the tubing hanger, the improvement comprising means for monitoring annulus pressure in an annulus between the inner casing and intermediate casing, comprising:

a casing hanger communication passage extending laterally through the upper casing hanger from the exterior of the upper casing hanger below the casing hanger seal to the bore of the upper casing hanger;

a tubing hanger communication passage, having an inlet on the exterior of the lower end of the tubing hanger which is in communication with the casing hanger communication passage and an outlet at the upper end of the tubing hanger, the tubing hanger communication passage being isolated from the flow passage of the tubing hanger;

a tubular extension member extending upward from the outlet of the tubing hanger communication passage; and a tree communication passage extending through the extension member and a portion of the tree and having an outlet on an exterior portion of the tree.

11. The subsea well according to claim 10, further comprising:

a communication line extending from the outlet of the tree communication passage to production equipment at the surface for communicating the annulus pressure through the casing hanger communication passage, tubing hanger communication passage, and tree communication passage to a pressure monitor.

12. The subsea well according to claim 10, further comprising:

a communication tube extending from the outlet of the tree communication passage to production equipment at a production platform for communicating the annulus pressure through the casing hanger communication passage, tubing hanger communication passage, and tree communication passage directly to a pressure monitor which measures the annulus pressure.

13. A method for monitoring annulus pressure in an annulus between inner and intermediate strings of casing of a subsea well, the subsea well having a wellhead housing secured to a string of outer casing, a lower casing hanger landed in the wellhead housing and secured to the string of intermediate casing, an upper casing hanger sealed by a casing hanger seal in the wellhead housing above the lower casing hanger and secured to the string of inner casing, the upper casing hanger having a bore which sealingly receives a lower end of a tubing hanger assembly, and a subsea tree assembly which mounts on the wellhead housing, the method comprising:

providing a casing hanger communication passage through the upper casing hanger from the exterior of the upper casing hanger below the casing hanger seal to an outlet in the bore of the upper casing hanger; and providing a tubing hanger and tree assembly communication passage which communicates with the outlet of the casing hanger communication passage and extends through at least a portion of the tubing hanger assembly and tree assembly to an outlet on the exterior of the tree assembly; then communicating the annulus pressure through the casing hanger communication passage and tubing hanger and tree assembly communication passage to the outlet on the exterior of the tree assembly; and communicating the annulus pressure from the outlet on the exterior of the tree assembly to a production platform.

14. The method according to claim 13, wherein the step of communicating the annulus pressure from the outlet on the exterior of the tree assembly to the production platform comprises:

extending a communication tube from the outlet on the exterior of the tree assembly to the production platform, and measuring the annulus pressure at the production platform.

* * * * *